United States Patent [19]

Bourget

[11] Patent Number: 4,494,307

[45] Date of Patent: Jan. 22, 1985

[54] METHOD OF MANUFACTURING ELECTRIC CABLE HAVING COMPRESSED MINERAL INSULATION AND A TITANIUM SHEATH

[75] Inventor: Jean-Claude Bourget, Issy-les-Moulineaux, France

[73] Assignee: Les Cables de Lyon, Clichy, France

[21] Appl. No.: 455,630

[22] Filed: Jan. 4, 1983

[30] Foreign Application Priority Data

Jan. 8, 1982 [FR] France ..... 82 00176

[51] Int. Cl.[3] ..... H01R 43/00

[52] U.S. Cl. ..... 29/825; 72/700

[58] Field of Search ..... 29/825; 72/700; 174/118, 102 R; 148/11.5 F, 11.5 R

[56] References Cited

U.S. PATENT DOCUMENTS

| | | | |
|---|---|---|---|
| 3,394,036 | 7/1968 | Parris | 148/11.5 F |
| 3,969,155 | 7/1976 | McKeighen | 72/700 X |
| 4,224,085 | 9/1980 | Brendel et al. | 428/600 X |

FOREIGN PATENT DOCUMENTS

| | | |
|---|---|---|
| 1097039 | 12/1967 | United Kingdom . |
| 2041260 | 9/1980 | United Kingdom . |
| 2100159 | 12/1982 | United Kingdom . |

*Primary Examiner*—Howard N. Goldberg
*Assistant Examiner*—Carl J. Arbes
*Attorney, Agent, or Firm*—Sughrue, Mion, Zinn, Macpeak, and Seas

[57] ABSTRACT

A method of manufacturing electric cable having compressed mineral insulation and a titanium sheath and at least one titanium inner conductor, said method including preparing a titanium sheath preform whose diameter is very much greater than that of the cable, then lengtening the preform by successive hammering and/or laminating operations between which the preform is annealed, wherein the titanium used contains not more than: 0.03% nitrogen; 0.25% oxygen; 0.015% hydrogen; 0.10% carbon and 0.30% iron; wherein its tensile strength is not more than 5.40 $N/mm^2$ wherein its breaking strain is at least 22%, and wherein annealing operations are performed in a rare gas atmosphere at a temperature lying between 600° C. and 640° C.

5 Claims, No Drawings

METHOD OF MANUFACTURING ELECTRIC CABLE HAVING COMPRESSED MINERAL INSULATION AND A TITANIUM SHEATH

The present invention relates to a method of manufacturing electric cable having compressed mineral oxide insulation and a titanium sheath and at least one titanium inner conductor, said method including preparing a titanium sheath preform whose diameter is very much greater than that of the cable, then lengtening the preform by successive hammering, rolling and/or drawing operations between which the preform is annealed.

BACKGROUND OF THE INVENTION

The Applicant's published French patent application FR-A-2 503 442 of Apr. 7, 1981 describes an electric cable having compressed mineral oxide insulation with a sheath and a metal inner conductor being manufactured by successive rolling operations on a preform between cylinders provided with grooves whose width and depth gradually decrease going from one pair to the next, with annealing operations being carried out between the rolling operations. The Applicant has observed that unless special precautions are taken, said method does not provide suitable quality sheathed cables when using ordinary-quality titanium for the sheaths and inner conductors, since the sheath cracks easily.

Preferred embodiments of the present invention overcome the above difficulty and provide an electric cable having compressed mineral oxide insulation and a titanium sheath plus at least one titanium inner conductor which has very good mechanical qualities and satisfactory surface condition and appearance.

SUMMARY OF THE INVENTION

In the method of the invention, the titanium used contains 0.03% nitrogen; 0.25% oxygen; 0.015% hydrogen; 0.10% carbon and 0.30% iron; and its tensile strength is not more than 540 N/mm$^2$ and its breaking strain is at least 22%, and the annealing operations are performed in a rare gas atmosphere at a temperature lying between 600° C. and 640° C.

Preferably, it also has a least one of the following features:

- each annealing operation lasts for about 15 minutes and is followed by a slow cooling process until ambient temperature is reached after at least 15 minutes.
- the titanium sheath preforms are lengthened by hammering and the preform is lengthed by about 35% between successive annealing operations.
- the titanium used contains not more than 0.03% nitrogen, 0.18% oxygen, 0.015% hydrogen, 0.10% carbon and 0.20% iron, and its tensile strength is not more than 410 N/mm$^2$ and its breaking strain is at least 30%.
- the preform undergoes an initial lengthening by a drawing operation.
- The quality of titanium to be used for the preform is available in trade under the name "Grade 2". An even better quality which is more suitable for the above method is known under the name of "Grade 1" but this quality is presently difficult to obtain in industrial quantities.

MORE DETAILED DESCRIPTION

A method of manufacturing electric cable having compressed mineral insulation made of magnesia and a sheath and inner conductor made of "Grade 2" titanium in accordance with the invention is described hereinafter by way of example.

Firstly, a titanium sheath preform of diameter 13.75 mm and a "Grade 2" titanium inner conductor are used, both meeting the conditions of impurity contents and mechanical properties set forth hereinabove. "Grade 1" titanium and "Grade 2" titanium are defined by German Standard DIN 17850. Their chemical compositions are as follows in percentage by weight:

| | Grade 1 | Grade 2 |
|---|---|---|
| Nitrogen | <0.03 | <0.03 |
| Oxygen | <0.08 | <0.12 |
| Carbon | <0.08 | <0.08 |
| Iron | <0.20 | <0.25 |

Said preform is subjected to an initial drawing operation to lengthen it by 20% until its diameter is 12.52 mm. The lengthened preform is subjected to annealing for 15 minutes at about 620° C. in an argon atmosphere followed by cooling to ambient temperature in 15 minutes.

The annealed preform is hammered until lengthened by about 35% thereby reducing its diameter to 10.8 mm. It is then subjected to the same annealing process of 15 minutes at 620° C. followed by cooling to ambient temperature in 15 minutes.

Then successive lengthening operations are performed to reduce the diameter to 9.3 mm, 8 mm, 6.90 mm, 5.95 mm, 5.15 mm, 4.40 mm, 3.80 mm and 3.20 mm, between which operations the preform is annealed as before. A cable is obtained whose sheath has excellent surface condition and is not cracked.

If "Grade 1" titanium of the quality corresponding to the severest requirements is available, the number of lengthening operations may be reduced by increasing the amount of lengthening at each operation.

The same preform can also be lengthened by rolling operations which allow lengthening per unit to be further increased and the final cable to be obtained after a smaller number of operations, but in that case cylinders with grooves specially adapted to cables with titanium sheaths and conductors must be used.

Insulants other than magnesia, e.g. alumina, could be used.

The invention applies more especially to manufacturing cables for measuring neutron fluxes under radiation, since irradiated titanium decontaminates twice as fast as previsouly used metals, e.g. stainless steel containing 200 parts per million of carbon, 18% chromium and 10% nickel, known under the names 22 CN 18-10 or AISI 304 L, and nickel-chronium-iron alloy containing 70% nickel, known under the name "Inconel 600".

I claim:

1. A method of manufacturing electric cable by interposing a compressed mineral oxide insulation between a titanium sheath and at least one titanium inner conductor and reducing the diameter of the cable so constituted, the improvement comprising:

preparing a titanium sheath preform whose diameter is very much greater than that of the finished cable, then lengthening the preform by successive mechanical deformation operations and performing annealing operations on the preform between said mechanical deformation operations, and wherein the preform is lengthened by about 35% between successive annealing operations;

wherein the titanium used contains not more than: 0.03% nitrogen; 0.25% oxygen; 0.015% hydrogen; 0.10% carbon and 0.30% iron;

wherein its tensile strength is not more than 540 $N/mm^2$, wherein its breaking strain is at least 22%, and wherein said annealing operations are performed in a rare gas atmosphere at a temperature lying between 600° C. and 640° C. and wherein each annealing operation is equivalent to that annealing obtained by heating a Grade 2 titanium sheath prefrom within that temperature range for fifteen minutes duration, and whose preform diameter of 12.52 mm is reduced through successive lengthening steps to 3.20 mm.

2. A method according to claim 1, wherein each annealing operation lasts for about 15 minutes and is followed by a slow cooling process until ambient temperature is reached after at least 15 minutes.

3. A method according to claim 1, including lengthening the preform by hammering.

4. A method according to claim 1, wherein the titanium used contains not more than 0.03% nitrogen, 0.18% oxygen, 0.015% hydrogen, 0.10% carbon and 0.20% iron, wherein its tensile strength is not more than 410 $N/mm^2$ and wherein its breaking strain is at least 30%.

5. A method according to claim 1, including initially lengthening the preform by drawing.

* * * * *